United States Patent [19]

Trout

[11] Patent Number: 4,798,502

[45] **Date of Patent: * Jan. 17, 1989**

[54] CORNER GROUTING NOZZLE

[75] Inventor: John F. Trout, St. Charles, Ill.

[73] Assignee: Lily Corporation, Aurora, Ill.

[ * ] Notice: The portion of the term of this patent subsequent to Apr. 9, 2002 has been disclaimed.

[21] Appl. No.: 88,999

[22] Filed: Aug. 21, 1987

Related U.S. Application Data

[63] Continuation of Ser. No. 746,051, Jun. 18, 1985, abandoned.

[51] Int. Cl.[4] ..... B65B 3/04; B29F 1/00; E02D 5/18; E04G 23/02

[52] U.S. Cl. ..... 450/269; 52/744; 141/293; 141/311 R; 425/13; 425/568; 425/DIG. 227

[58] Field of Search ..... 405/229, 240, 241, 258, 405/260, 266, 269; 52/514, 704, 743, 744, 749; 425/11, 12, 13, 568, DIG. 227; 141/311 R, 325, 392; 156/94, 578; 264/36

[56] References Cited

U.S. PATENT DOCUMENTS

| | | | |
|---|---|---|---|
| 3,260,053 | 7/1966 | Miller | 405/266 X |
| 3,572,956 | 3/1971 | Liscum | 52/744 X |
| 3,661,679 | 5/1972 | Law | 156/578 X |
| 4,044,512 | 8/1977 | Fischer et al. | 52/744 X |
| 4,352,262 | 10/1982 | Edelmann et al. | 52/744 |
| 4,382,720 | 5/1983 | Vonach | 405/269 |
| 4,509,884 | 4/1985 | Trout et al. | 405/269 |

FOREIGN PATENT DOCUMENTS

| | | | |
|---|---|---|---|
| 85419 | 5/1982 | Japan | 405/266 |

*Primary Examiner*—Randolph A. Reese
*Assistant Examiner*—John A. Ricci
*Attorney, Agent, or Firm*—James D. Hall

[57] ABSTRACT

A nozzle utilized to grout or fill cold joints and cracks formed in or occuring at structural corners. The nozzle includes a tip which is defined by converging planar surfaces about an axial opening. The nozzle tip defining surfaces include a relatively large area which is separated from the nozzle axial opening for wall contact to permit the nozzle to be secured by an adhesive or bonding agent to the corner walls before injection of the grouting material or sealant.

1 Claim, 1 Drawing Sheet

CORNER GROUTING NOZZLE

This is a continuation of co-pending application Ser. No. 06/746,051 filed on June 18, 1985, now abandoned.

SUMMARY OF THE INVENTION

This invention relates to a grouting nozzle and will have special application to a nozzle for grouting structural corners.

U.S. Pat. No. 4,509,884 discloses a nozzle for injecting adhesive materials into cracks in concrete, mortared joints in brick or stone walls, timber or similar materials.

The corner grouting nozzle of this invention includes a nozzle having a V-shaped tip defined by converging planar surface areas about an exit opening in an axial bore. The nozzle surface material about the opening is of minimal thickness relative to the overall transverse dimensions of the nozzle as to minimize backpressure of sealant or adhesive. Each of the coverging nozzle tip-defining faces also includes a relatively large surface area which is separated from the nozzle exit opening and which permits the nozzle to be secured by a bonding agent to the corner walls before injection of a sealant or adhesive.

Accordingly, it is an object of this invention to provide a corner grouting nozzle which is used to grout or fill cold joints, cracks, and similar voids between intersecting structural members.

Another object of this invention is to provide a corner grouting nozzle which will minimize back pressure of sealant or adhesive.

Other objects of this invention will become apparent upon a reading of the following description.

BRIEF DESCRIPTION OF THE DRAWINGS

A preferred embodiment of the invention has been depicted for purposes of illustrations wherein.

DESCRIPTION OF THE PREFERRED EMBODIMENT

Figure 1:
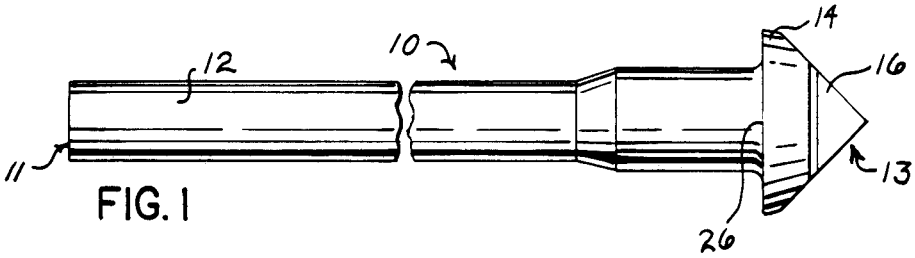
FIG. 1 is a side view of the nozzle having its shank shown in fragmentary form.
Figure 2:
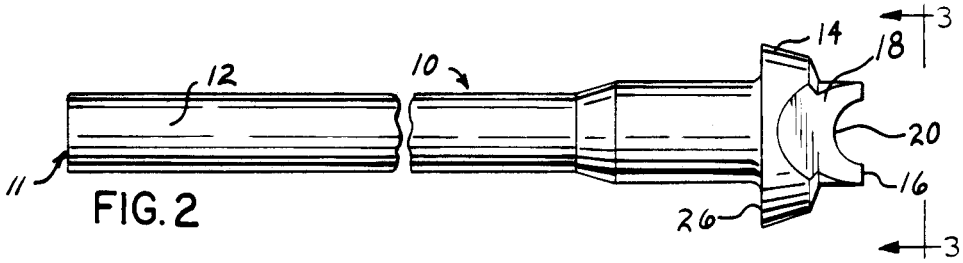
FIG. 2 is a side view of the nozzle as seen ninety degrees displaced from the view of FIG. 1.
Figure 4:
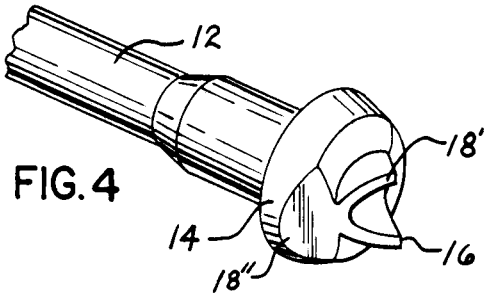
FIG. 4 is a fragmentary perspective view of the nozzle as seen from the front.
Figure 3:
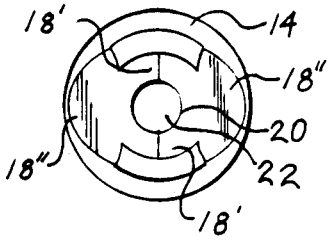
FIG. 3 is an end view of the nozzle head as seen from line 3—3 of FIG. 2.

The preferred embodiment herein described is not intended to be exhaustive or to limit the invention to the precise form disclosed. It is chosen and described to explain the principles of the invention and its application and practical use to enable others skilled in the art to utilize the invention.

FIGS. 1–4 depict a corner grouting nozzle 10 which includes a proximal end 11, a shank 12 and a distal end or head 13. Nozzle 10 includes an axial bore 22 which extends through shank 12 from proximal end 11 to head 13. Thus far, described nozzle 10 is of the same design as that disclosed in U.S. Pat. No. 4,509,884 which is incorporated herein by reference.

Head 13 of nozzle 10 includes a V-shaped tip 16 defined by two right angular converging planar surfaces 18 which are symmetrically oriented about axial opening 20 of bore 22 and which intersect a collar 14 forming a part of head 13. Each surface 18 includes a narrow section 18' at nozzle bore opening 20 and a wide section 18'' at collar 14.

Figure 5:
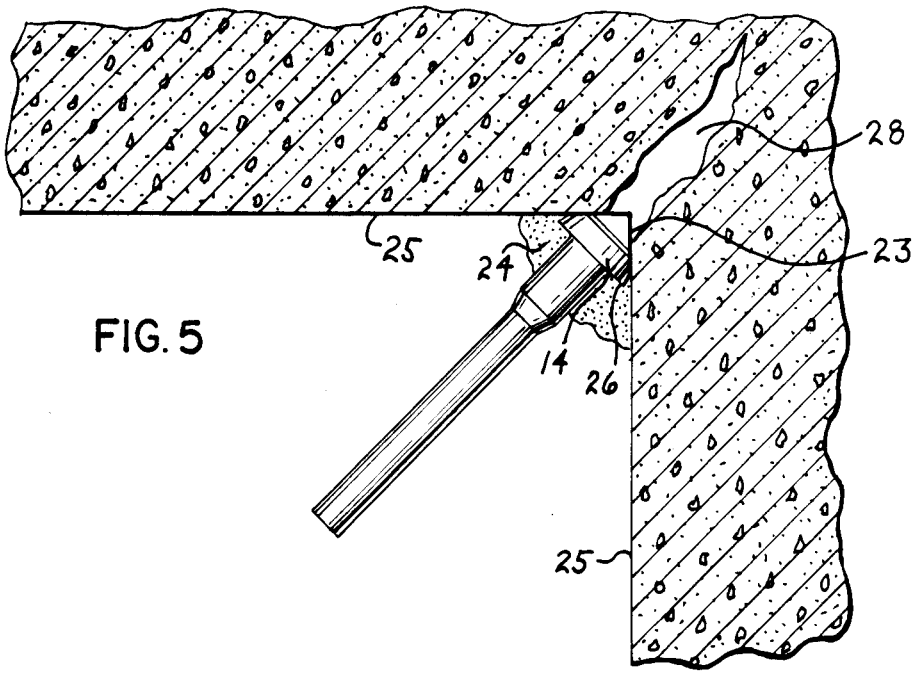
FIG. 5 is a fragmentary view showing the nozzle mounted against adjoining concrete walls with the walls shown in sectionalized form for purposes of illustration.

Nozzle 10 is utilized as follows. First, an adhesive or bonding agent is applied to surfaces 18 of its tip 16. Nozzle head 13 is then positioned with its tip 16 fitting complementally into corner 23 of adjoining walls 25 overlying crack 28. The adhesive applied to the nozzle tip 16, especially at surfaces 18'', causes the nozzle to adhere to walls 25. A bonding gel coat 24 is then applied over crack 28 in corner 23 and about the back side 26 of nozzle collar 14 to firmly bond the nozzle to walls 25 at corner 23 and complete the seal at crack 28, as seen in FIG. 5. The proximal end 11 of the nozzle 10 is then connected by a conventional coupling to a source of sealant. An epoxy, adhesive or sealant is pumped through axial bore 22 of nozzle 10 and injected into crack 28 in corner 23. This injection of the material may occur at pressures as high as 300–400 psi. The narrowness of converging planar surfaces 18' of nozzle tip 16 adjacent to corner 23 minimize blow-back of the nozzle during injection. Once the crack 28 is filled, a clamp (not shown) is used to crimp the shank 12 of the nozzle 10 which prevents the escape of the epoxy from the crack 28. The sealant source coupling is then disconnected from nozzle 10. After the epoxy cures, the protruding end of the nozzle may be cut off generally flush with the corner, left in place, or removed by chipping.

It is understood that the invention is not limited to the above given details, but may be modified within the scope of the appended claims.

I claim:

1. A nozzle for injecting sealant into a crack at a corner of two adjoining walls, said nozzle comprising a shank having proximal and distal ends, said shank having an axial bore therethrough communicating with its said proximal and distal ends, said nozzle distal end defining a head having a collar and an integral protruding tip, said tip and at least a portion of said collar being formed by substantially V-shaped converging surfaces adapted for a complemental fit into said corner adjacent said crack, said converging surfaces at said tip forming a thin walled means for minimizing blow-back of said nozzle upon injection of said sealant into said crack, said converging surfaces at said collar forming oppositely disposed contact means for accommodating an adhesive to secure said nozzle to said adjoining walls at said corner with said tip positioned over said crack.

* * * * *